US006782787B2

(12) United States Patent
Morehead et al.

(10) Patent No.: US 6,782,787 B2
(45) Date of Patent: Aug. 31, 2004

(54) ADJUSTABLE PUNCH HAVING EXTERNALLY ACCESSIBLE ROTATION RELEASE LATCH

(75) Inventors: John H. Morehead, White Bear Lake, MN (US); Jon M. Shimota, Stillwater, MN (US)

(73) Assignee: Wilson Tool International, Inc., White Bear Lake, MN (US)

( * ) Notice: Subject to any disclaimer, the term of this patent is extended or adjusted under 35 U.S.C. 154(b) by 0 days.

(21) Appl. No.: 09/921,451

(22) Filed: Aug. 2, 2001

(65) Prior Publication Data

US 2003/0024367 A1 Feb. 6, 2003

(51) Int. Cl.[7] ..... B26D 1/00

(52) U.S. Cl. ..... 83/679; 83/684; 83/686; 83/697

(58) Field of Search ..... 83/686, 696, 697, 83/684, 671.1, 530, 699.31, 640, 679

(56) References Cited

U.S. PATENT DOCUMENTS

| | | | | |
|---|---|---|---|---|
| 2,172,272 A | | 9/1939 | Booth | |
| 3,122,044 A | | 2/1964 | Grosh | |
| 3,719,117 A | * | 3/1973 | Mauk et al. | 83/698.91 |
| 4,031,787 A | | 6/1977 | Cady | |
| 4,141,264 A | | 2/1979 | Weisbeck | |
| 4,375,774 A | | 3/1983 | Wilson et al. | |
| 4,526,077 A | * | 7/1985 | DeGuvera | 83/686 |
| 4,570,327 A | * | 2/1986 | Klingel et al. | 483/1 |
| 4,862,782 A | * | 9/1989 | Ernst | 83/552 |
| 4,993,294 A | * | 2/1991 | Chun et al. | 83/139 |
| 5,020,407 A | | 6/1991 | Brinlee | |
| 5,131,303 A | | 7/1992 | Wilson et al. | |
| 5,271,303 A | * | 12/1993 | Chatham | 83/136 |
| 5,301,580 A | * | 4/1994 | Rosene et al. | 83/136 |
| 5,329,835 A | | 7/1994 | Timp et al. | |
| 5,839,341 A | | 11/1998 | Johnson et al. | |
| 6,047,621 A | | 4/2000 | Dries et al. | |
| 6,276,247 B1 | * | 8/2001 | Helda | 83/684 |

FOREIGN PATENT DOCUMENTS

EP 0 727 263 A1 8/1996

* cited by examiner

*Primary Examiner*—Kenneth E. Peterson
*Assistant Examiner*—Omar Flores-Sanchez
(74) *Attorney, Agent, or Firm*—Fredrikson & Byron, P.A.

(57) ABSTRACT

A punch tool including a punch driver and a punch element. The punch element can include a punch secured to a punch holder, with the punch holder and punch slidably disposed within a punch guide. The effective length of the punch tool can be increased by rotating the punch driver about threads relative to the punch element. The punch tool includes a latch mechanism for preventing rotation of the punch driver relative to the punch element when the latch is in a locked position, but allowing such rotation when the latch is in an unlocked position, thereby controlling unwanted free rotation of the punch driver relative to the remainder of the punch tool. During punching operation, the punch driver, punch holder, and punch are forced slidably relative to the outer punch guide. When a length adjustment is desired, the punch driver can be rotated relative to the punch, punch holder, and punch guide, which typically do not rotate. A locking disk can be rotatably secured to the punch driver. One punch tool locking disk has downwardly open cavities for receiving an upwardly protruding latching member which can be downwardly retracted to allow free rotation of the locking disk. Another punch tool locking disk has radially inwardly extending cavities or indents, and a latching member which can be positioned to block or allow passage of the non-indented portions past the latching member. The latching mechanism provided is isolated from the punch driver by springs, and easily accessible to operators from the side.

3 Claims, 11 Drawing Sheets

230

238
239
214
241
243
235B
235A
240
250
260
262
286
255
284
282
280
234S
202
232
233
289
293
291
290
272
271
234

310
239
238
243

ADJUSTABLE PUNCH HAVING EXTERNALLY ACCESSIBLE ROTATION RELEASE LATCH

FIELD OF THE INVENTION

The invention relates generally to punch set assemblies used in punch presses, and particularly to adjustable length punch set assemblies wherein the punch may be adjusted to compensate for punch blade length reduction due to sharpening.

BACKGROUND OF THE INVENTION

Repeated use of a punch assembly in a punch press operation results in the natural dulling and wear of the punch blade or tip. Once the tip has become dull, the effectiveness of the punch assembly is reduced and the punch tip must be sharpened. Sharpening may be accomplished by grinding the end of the punch tip, and this results in shortening the length of the blade and, consequently, the punch. The length of the punch then must be adjusted to compensate for the ground-off portion of the punch blade.

A first type of punch set assemblies that allow for length corrections are exemplified in U.S. Pat. Nos. 4,031,787 and 4,141,264. These patents disclose punch sets that compensate for the shortened punch blade length by adding shims, washers or other similar objects to the punch. The problem with this method is that the added washers or the like are usually weak and cannot withstand the constant cyclical forces placed upon a punch. Also, the length of the punch tip can only be adjusted within certain limits before it becomes too short for effective operation, thereby limiting the number of times the punch tip can be sharpened. In addition, most such methods that allow for the adjustment of the length of the punch tip require dismantling of the entire punch in order to access the punch tip for adjustment; this obviously can be a rather time-consuming process. Additionally, once the punch has been reassembled, further effort is frequently expended in determining how much the sharpening and adjusting steps have affected the axial position of the tip with reference to the plane of the stripper plate opening that it extends through in use.

Improvements on these known methods are described in commonly assigned U.S. Pat. No. 4,375,774 and in U.S. Pat. No. 5,131,303. In these patents, the punch driver and punch holder or body components of the punch are attached by mutually engageable threaded portions so that overall punch length adjustment may be accomplished by rotation of the threaded portions. Locking mechanisms are provided in each case. In the '774 patent, an expandable locking pin is inserted into aligned locking pin holes wherein it interferes with and prevents rotation of the threaded portions. While simplifying the axial length adjustment process, this approach requires removal and re-insertion of the locking pin.

In the '303 patent, the assembled punch is axially slidably received within a bore provided in a punch guide. A releasable lock for locking the threaded ends against relative rotation is provided by an arcuate wire clip having a radially inwardly extending cam pin. The arcuate clip is retained in an annular groove and radially inwardly extending bore in the punch holder so that the cam pin extends inwardly and into engagement with a set of circumferentially distributed grooves in the male threaded end of the punch body. Length adjustment in either direction is provided by rotating the punch body with respect to the punch holder so that the cam tip is released from one groove and engages a further groove.

An adjustable length forming tool head is disclosed in U.S. Pat. No. 5,020,407 which discloses a length adjustment in the threaded connection between the punch driver and the punch head base which in turn is attached to a form tool body. A length control ring member is spring biased away from and between the driver and the base and is formed with a central opening for engaging the shaft of the driver to prevent their relative rotation and a set of circumferentially spaced apertures for engaging a pair of pins extending from the base. Adjustment is accomplished by grasping the ring member and driver to withdraw the ring member from engagement with the pins and to rotate them until the next desired set of diametrically opposed apertures is aligned with the pins. Since the form tool does not have a punch set spring encircling the punch head, it is possible to grasp the ring member and make the length adjustment. Such an arrangement would not be useable in punch sets having a punch spring encircling the punch head, driver and holder components of the type disclosed in the above referenced patents and application.

Another adjustable length punch tool is disclosed in commonly assigned U.S. Pat. No. 5,329,835. The tool includes a punch holder secured to a punch with a mounting bolt. The punch holder is threadably engaged with the punch driver. The length of the punch tool is adjusted by rotating the punch driver relative to the punch holder about the engaged threads. The punch driver would be free to undesirably rotate about the punch holder, but for the inclusion of a locking button.

The '835 patent locking button has a generally square, cubic shape having upper square corners and a square profile. The button is biased upward by a biasing spring to force the square button top into a downwardly open, square receiving pocket in the punch driver. The square lower body of the button is slidably received within an upwardly open square pocket in the punch holder. In the upwardly biased, locked position, the square button acts as a key, preventing rotation between the punch driver and the punch holder by extending between the two. When the button is depressed further into the receiving pocket in the punch holder, for example by an operator depressing the accessible button, the bottom no longer bridges the punch driver and punch key, and the punch driver may be rotated relative to the punch holder. The button is thus in contact with the punch driver, and may occasionally, after frequent repeated blows by the ram, become worn by interaction between button and punch driver upper receiving pocket. This is undesirable.

What would be desirable is a punch tool having a punch driver rotation lock that is less likely to become worn through the repeated pounding action of the ram. What would also be advantageous is a locking mechanism allowing access from outside the punch tool, not requiring operator access through the top central bore of the punch tool.

SUMMARY OF THE INVENTION

The present invention provides a punch tool which can be used with punch presses. The punch tool includes generally a punch driver and a punch element. The punch element can include a punch secured to a punch holder together with a punch guide, with the punch holder and punch slidably received within the punch guide. The punch driver, during production use, can be forced by a hydraulic ram downward, forcing the attached punch holder and punch axially downward, past the bottom of the punch guide, and through a work piece against a receiving die. The effective length of the punch tool can be adjusted, as the punch holder and punch driver can be threadably mated together. The threaded punch driver can be rotated relative to the punch holder, punch, and punch guide, thereby lengthening or shortening the effective length of the punch tool. The punch tool may need to be periodically adjusted to compensate for the shortening of the punch lower portion caused by wear and by grinding to sharpen the punch cutting surface.

As free and uncontrolled rotation of the punch driver relative to the punch holder is undesirable, the present invention provides mechanisms for enabling and disabling rotation of the punch driver relative to the punch holder, punch, and punch guide. The present invention provides a locking disk or collar secured to the punch driver as well as a latch secured to the punch guide. In a locked position, the latch prevents rotation of the locking disk relative to the latch, thereby preventing rotation of the attached punch driver relative to the punch holder. In an unlocked position, the latch permits rotation of the locking disk and attached punch driver relative to the punch holder.

With respect to axial movement, the punch driver, locking disk, punch holder, and punch move together as one when forced by a ram. With respect to rotation, rotation of any of the punch driver, locking disk, punch holder, punch, and punch guide are typically prevented during production. When adjustment of the effective length of the punch tool is desired, the punch driver and locking disk rotate together relative to the punch holder, punch, punch guide, and latching member which typically move together as one, and which do not rotate. Unlocking the latch, therefore, allows the punch driver and locking disk to be rotated relative to the other parts.

In one punch tool, the tool includes a punch element with a punch having a lower punch tip or cutting tip, and a punch driver element having an upper surface adapted to be engaged by the ram of a punch press in a punching operation. The punch element and punch driver element can be axially aligned and threaded together to enable axial adjustment of the length of the combined punch driver and punch in response to relative rotation of the punch driver and punch. One of the punch driver element or punch element can have a latch adjacent its periphery, spaced apart from its axis, and moveable along an axis parallel to the axis of the punch element and punch driver element. The latch can be moveable between an upper, locked position, preventing relative rotation of the elements, and a lower unlocked position, permitting relative rotation of the elements. The latch can include a spring having a predetermined spring constant acting to urge the latch into its upper locked position, the latch having a sufficiently low mass and the spring having a sufficiently great spring constant so as to prevent the latch from unintentional movement into the unlocked position in response to a striking of the punch driver element by a punch press ram during a punching operation.

In another punch tool, the punch element includes a punch guide having a bore, through which the punch axially moves in a punching operation, and the punch guide includes an upper peripheral portion having a housing receiving the latch and spring. The punch driver element can include a plurality of axially extending cavities receptive of the latch when the latch is in its upper locked position, to prevent rotation of the punch driver element with respect to the punch guide.

In still another punch tool, the punch guide has an upper rim and the punch driver includes a locking disk positioned beneath the upper rim of the punch guide. The disk can have a plurality of circumferentially spaced grooves in its outer periphery defining the cavities in position to receive the latch when the latch is in its upper, locked position. In another embodiment, the punch tool includes a latch having a body configured to be actually received in the grooves of a locking disk, the latch body having a recess along its length that receives the disk when the latch is moved to its lower unlocked position to enable the disk to rotate with respect to the latch. In yet another embodiment, the latch includes a manually accessible surface extending upwardly no higher than the rim to facilitate manual downward movement of the latch. In still another embodiment, the punch guide has a generally cylindrical outer surface, and carries the housing at least partially outside of the cylindrical surface to facilitate manual operation of the latch.

Yet another punch tool includes a punch driver element having an outer periphery with vertically extending, circumferentially spaced, downwardly open slots defining the cavities in position to receive the latch when the latch is in its upper, locked position. In one tool punch embodiment, the latch includes a vertically extending shaft slidable vertically in the housing, and a manually accessible outwardly protruding key mounted to the shaft to facilitate manual movement of the shaft.

DETAILED DESCRIPTION OF THE PREFERRED EMBODIMENT

The following detailed description should be read with reference to the drawings, in which like elements in different drawings are numbered identically. The drawings, which are not necessarily to scale, depict selected embodiments and are not intended to limit the scope of the invention. Several forms of invention have been shown and described, and other forms will now be apparent to those skilled in art. It will be understood that embodiments shown in drawings and described above are merely for illustrative purposes, and are not intended to limit scope of the invention as defined in the claims which follow.

Figure 1:
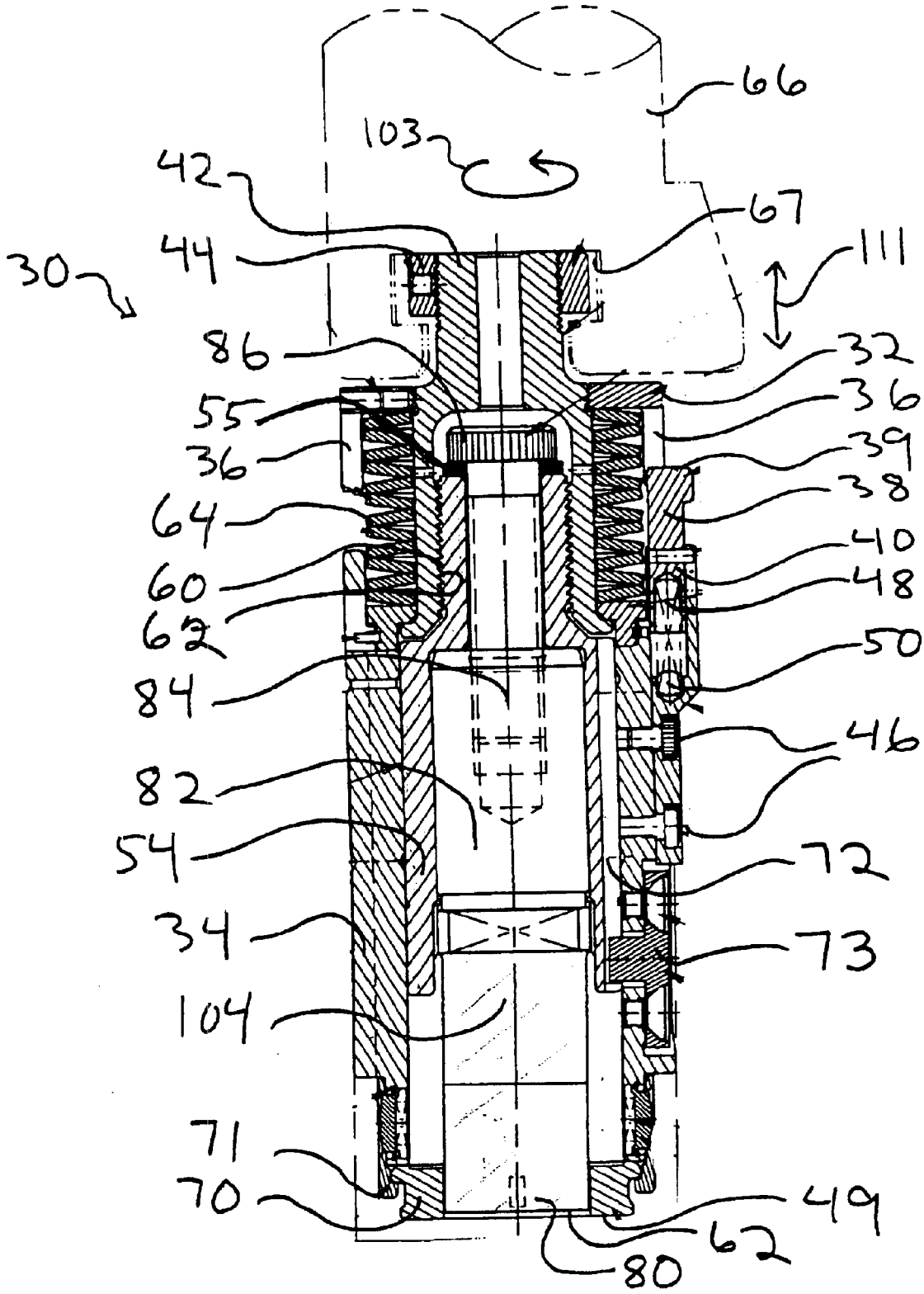
FIG. 1 is a longitudinal, cross-sectional view of one punch tool according to the present invention.

Referring now to FIG. 1, a punch tool 30 is illustrated. Punch tool 30 may be described with respect to two movements of the punch tool. The first movement is the normal, axial, vertical punching movement which will occur periodically as the punch is forced through a work piece under the driving force of a ram, commonly against a receiving die. The second movement is less frequent, and involves a rotational movement of the punch tool, which may be performed in order to adjust the effective length of the punch tool to compensate for shortening caused by wear and by the sharpening of the punch tip.

Punch tool 30 includes a punch driver 42 which can be secured to a punch driver locking disk portion 32. Punch driver 42 may be threadably and fixably received by locking disk portion 32. In normal use, punch driver 42 and punch driver locking disk portion 32 move axially together, as indicated by arrows at 111. This movement is in response to punch driver 42 being struck by a ram 66, imparting a downward movement to punch driver 42.

A punch holder 54 may be securely disposed within punch driver 42 and may, in turn have a punch 104 held by or secured to punch holder 54. Punch 104 typically terminates in a punch tip portion 80. Punch 104 may include an upper mounting bolt 84, a punch body 82, and the lower cutting tip 80. A punch guide 34 may have punch 104 and punch holder 54 slidably received within. Punch 104 and punch holder 54 are typically secured against rotation relative to punch guide 34.

Locking disk portion 32 may be upwardly biased by disk springs 64, and forced away from punch guide 34. In normal use, a ram will force punch driver 42, punch holder 54, and punch 104 together axially downward through punch guide 34, such that punch tip portion 80 is forced downward and through the work piece (not shown in FIG. 1). After the force of the ram is removed, biasing disk springs 64 force locking disk portion 32 and punch driver 42 upward, ready to receive the next downward force from the ram.

Punch tool 30 may also be described with respect to the rotational movement which can be used to adjust the effective length of the punch tool. Punch driver 42 may be seen to have internal threads 60 which are threadably engaged with a set of punch holder external threads 62. In normal use, and during length adjustment, punch 104 may be secured against rotation with respect to punch guide 34 and punch holder 54. Punch 104, punch guide 34, and punch holder 54 may have a key and/or a keyway in one or both members in order to prevent unwanted rotation of punch 104 during use. The securing of punch 104 against rotation within punch guide 34 and punch holder 54 leaves the rotation of punch driver 42 about threads 60 and 62 as the remaining rotational possibility. In order to adjust the effective length of punch tool 30, punch driver 42 may be rotated, as indicated by arrows at 103. During normal punching use, however, the free rotation of punch driver 42 is generally undesirable.

In order to prevent unwanted rotation, a latch member 38 is illustrated. Latch member 38 can be secured to punch guide 34, but with locking disk 32 free to travel axially relative to latch member 38. With latch member 38 being secured to punch guide 34 and locking disk portion 32 being secured to punch driver 42, if latch member 38 prevents the rotation of locking disk portion 32, the free rotation of punch driver 42 relative to punch holder 54 is prevented. Similarly, the release of latch member 38 from locking disk portion 32 will allow punch driver 42 to be rotated about threads 60, thereby allowing the length adjustment of punch tool 30.

Punch guide 34, punch holder 54, and punch 104, may together be considered to be a "punch element." The punch element may thus be rotatably mounted relative to punch driver 42. Latch member 38 may thus control the ability of the punch element to rotate or not rotate relative to punch driver 42. Latch member 38 can thus enable or disable the ability to adjust the effective length of punch tool 30. It should be noted that, in this embodiment, latch member 38 is not carried by punch driver 42, and is not struck by the ram. It may also be noted that latch member 38 is accessible to operators from the side of the punch, rather than from within a top, central bore.

Referring further to FIG. 1, punch tool 30 is discussed in more detail. Punch driver 42 has a punch driver head or head nut 44 attached to punch driver 42. Ram 66 (shown in phantom in FIG. 1) may be seen to have a slot 67 for receiving punch driver 42 and punch driver head 44. Latch member 38 may be seen disposed within a latch housing 40. Latch housing 40 may be seen to include a latch biasing spring 48 within a latch spring blind cavity 50. Latch housing 40 is secured to punch guide 34 using latch housing mounting holes 46. Punch holder 54 may be seen to include a top washer 55.

Punch 104 of FIG. 1 is illustrated as having three main components: lower punch tip portion 80, punch body 82, and upper punch mounting bolt 84 having a punch mounting bolt head 86. Punch mounting bolt 84 may be threadably secured to punch body 82 with punch mounting bolt head 86 being rotated against washer 55. Mounting bolt 84 may be rotated until punch body 82 is secured by tension against punch holder 54. Punch guide 34 includes a bottom surface 49 and a bottom orifice 62 extending therethrough. In some embodiments, punch guide 34 has a stripper plate 70. Stripper plate 70 can be releasably secured with a stripper plate ring 71. A keyway is represented diagrammatically at 72, and a corresponding key is shown at 73. Key 73 and keyway 72 can be used to prevent free rotation of the punch tool including punch tool lower portion 80 within punch guide 34.

As may be seen from inspection of FIG. 1, a force applied by ram 66 to punch driver 42 will be transmitted through threads 60 and 62 to punch holder 54 and to the punch, thereby slidably moving the punch past stripper plate 70. Upon the release of force from ram 66, disk springs 64 will force punch driver 42 upwardly through punch guide 34. As may also been seen from inspection of FIG. 1, punch driver 42 would be free to rotate relative to punch holder 54 about threads 60 and 62, absent any connection between latch member 38 and punch driver 42.

Figure 2:
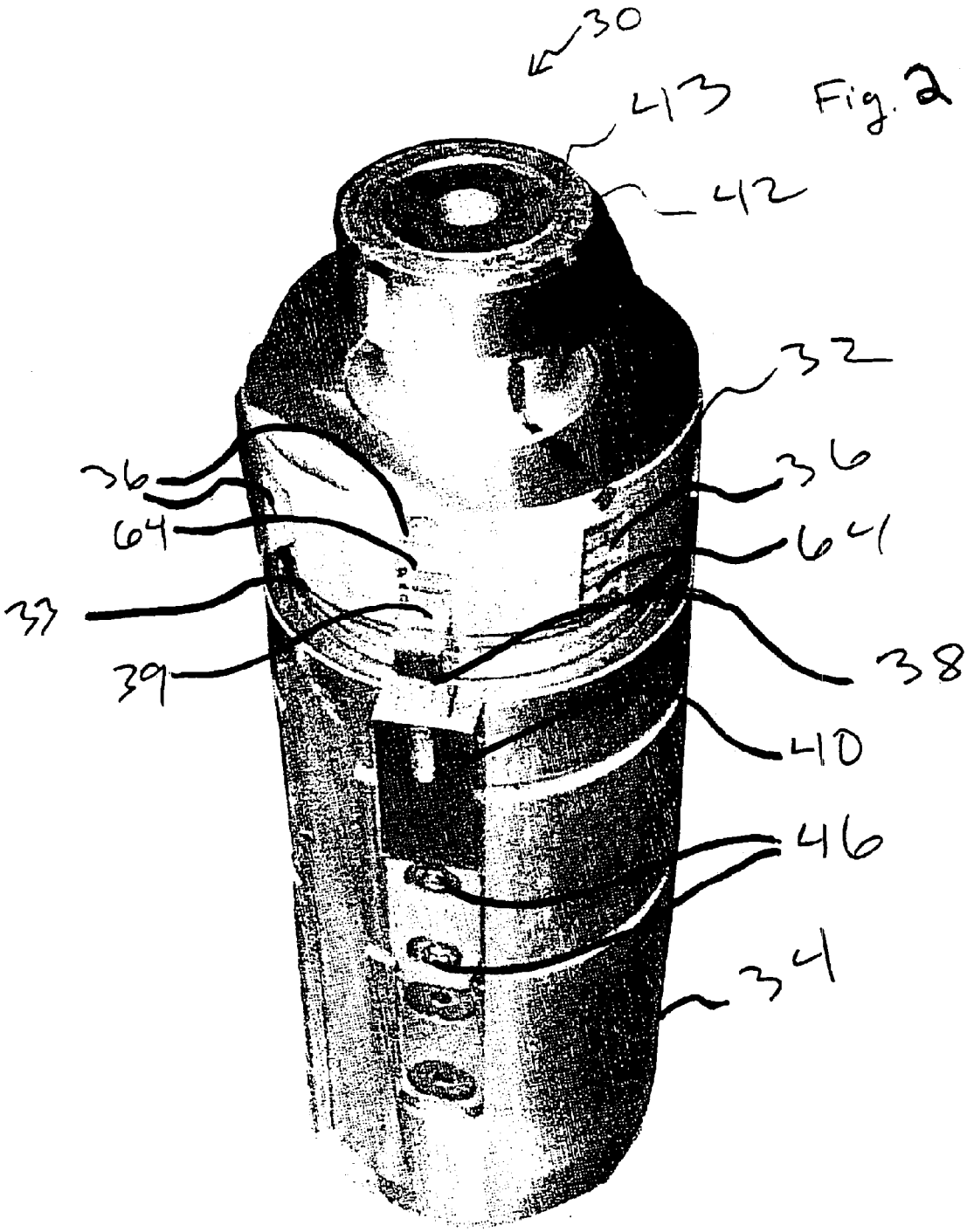
FIG. 2 is a top, perspective view of the punch tool of FIG. 1, including a locking disk with downwardly open locking cavities.

Referring now to FIG. 2, a perspective view of punch tool 30 is shown, including punch driver 42 having a punch driver top 43 having an upper surface. Punch driver 42 is secured to is locking disk or collar 32. Locking disk 32 includes a plurality of axially oriented, downwardly open cavities or slots 36 disposed about the cylindrical, outer periphery of locking disk 32. Disk springs 64 are visible through slots 36. Punch guide 34 is also shown, having latch housing 40 secured to punch guide 34 through latch housing mounting holes 46. Axially slidable latch member or finger 38 may be seen to be slidably disposed within latch housing 40. Latch member 38 includes a top portion 39 which may seem to extend partially within slot 36. Latch 38 may be upwardly biased by a latch spring (not shown in FIG. 2) disposed within latch housing 40. In the upwardly biased position, latch top portion 39 may be seen to be disposed above the bottommost portion 33 of locking disk 32. While in the upwardly biased position, latch upper portion 39 may be seen to not extend upward against the top of slot 36. The clearance thus provided allows locking disk 32 to be forced downward over latch member 38 during the normal, periodic, downward movement of punch driver 42 caused by a ram.

When the adjustment of the effective length of punch tool 30 is desired, latch 38 may be depressed downward against the latch biasing spring, below locking disk bottommost portion 33, allowing locking disk 32 to be rotated relative to punch guide 34. As previously described, locking disk 32 and punch driver 42 can rotate together relative to the punch element, which can include together the punch guide, the punch holder, and the punch (with only the punch guide being visible in FIG. 2). During normal punching use, punch driver 42 and locking collar 32 may move downwardly together against disk springs 64 to force the punch tool from the bottom of punch guide 34. As may be seen from inspection of FIG. 2, the downward pounding of a ram against punch driver 42 is isolated from both the latch 38 and latch housing 40. Punch driver 42 is thus isolated from latch 38 by disk springs 64. In the event any vibration is transmitted to latch 38, even small repeated movements of latch 38 within latch housing 40 will not cause excessive wear on the system or allow unwanted rotation or extension of punch tool 33. In one embodiment, the latch spring has a sufficiently great spring constant, and latch member a sufficiently small mass, so as to prevent any unintentional movement of latch 38. Latch 38 may be seen to be accessible to operators from the side.

Figure 3A:
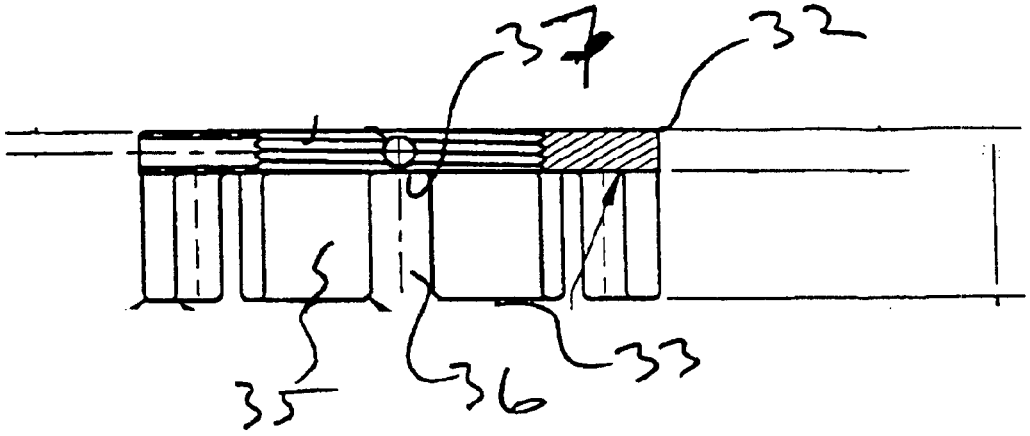
FIG. 3A is a side view of the locking disk of FIGS. 1 and 2.

Referring now to FIG. 3A, locking disk or collar 32 is further illustrated in a side view. Locking disk 32 illustrates downwardly open cavities or slots 36, having an uppermost portion 37. Locking disk 32 also includes disk portions 35 having full circumference disposed between slots 36, having bottommost portion 33.

Figure 3B:
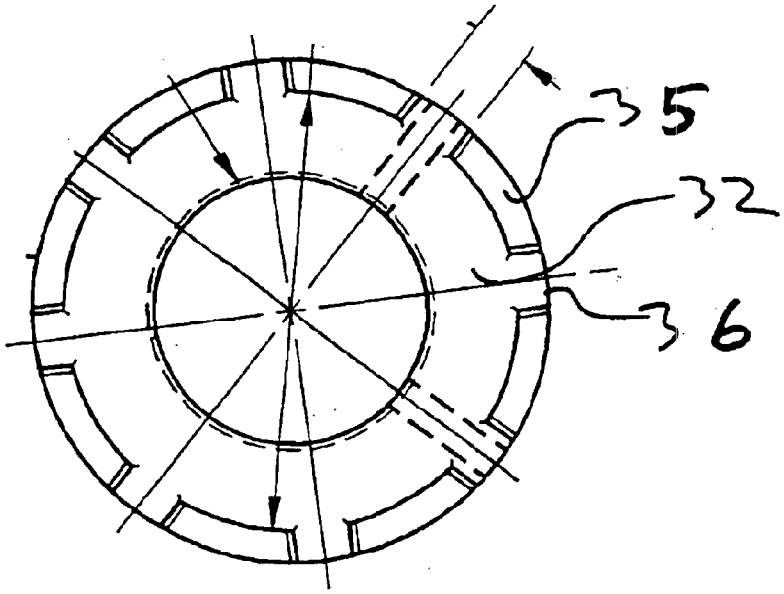
FIG. 3B is a bottom view of the locking disk of FIGS. 1 and 2.

Referring now to FIG. 3B, a bottom view of locking disk or collar 32 of FIG. 3A is shown. Locking disk 32 includes the downwardly extending slots 36 and the inter-slot, fall circumference portions 35, as previously described.

Figure 4:
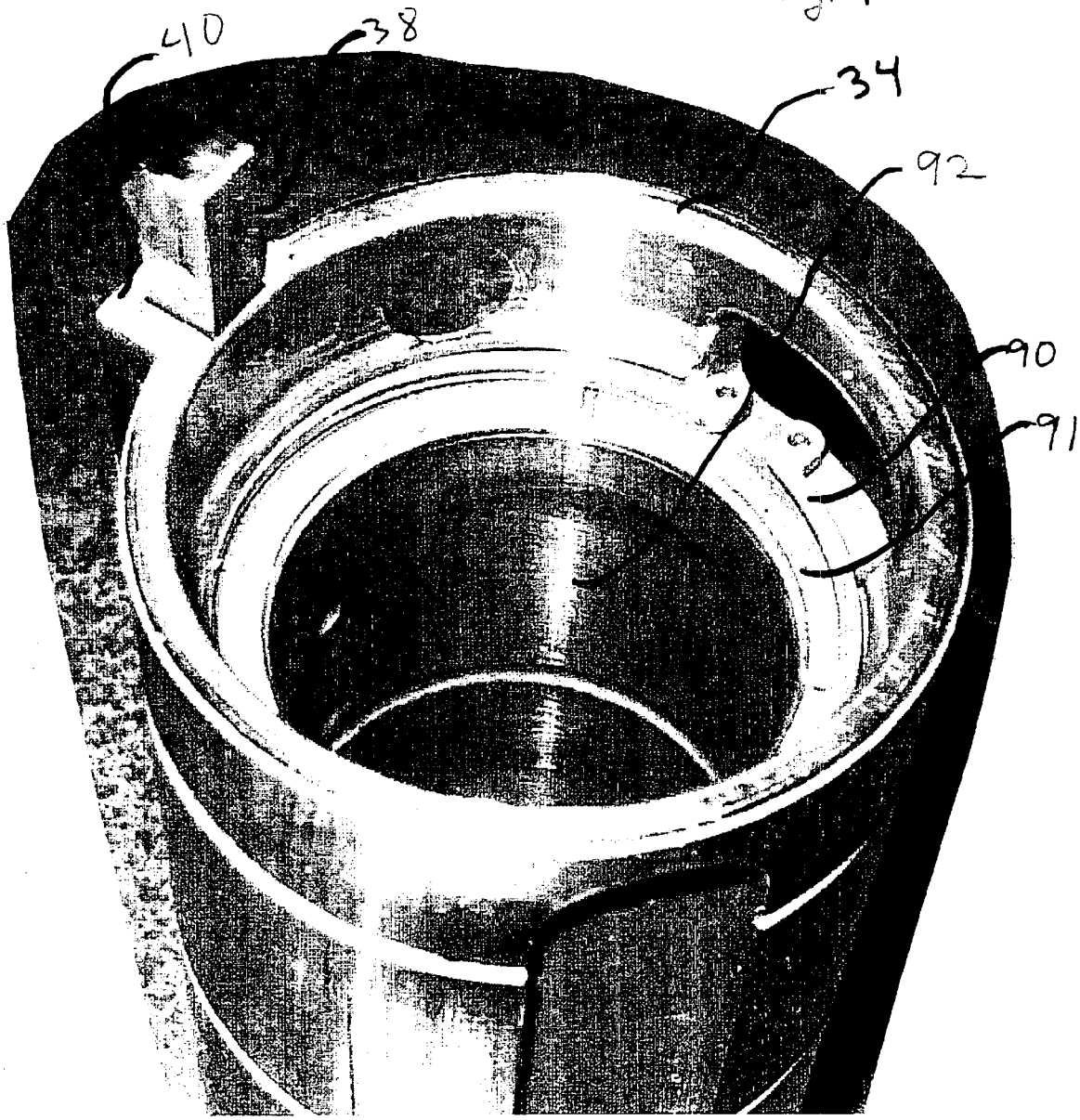
FIG. 4 is a top, perspective view of the punch guide of FIGS. 1 and 2.

Referring now to FIG. 4, punch guide 34 is further illustrated, having latch member or finger 38 extending upwardly from latch housing 40. Punch guide 34 may be seen to include within a spring support or shoulder region 91 for supporting the disk springs, surrounded by a snap ring 90. Punch guide 34 may also be seen to have a bore interior wall 92 within for slidably receiving the punch holder.

Figure 5:
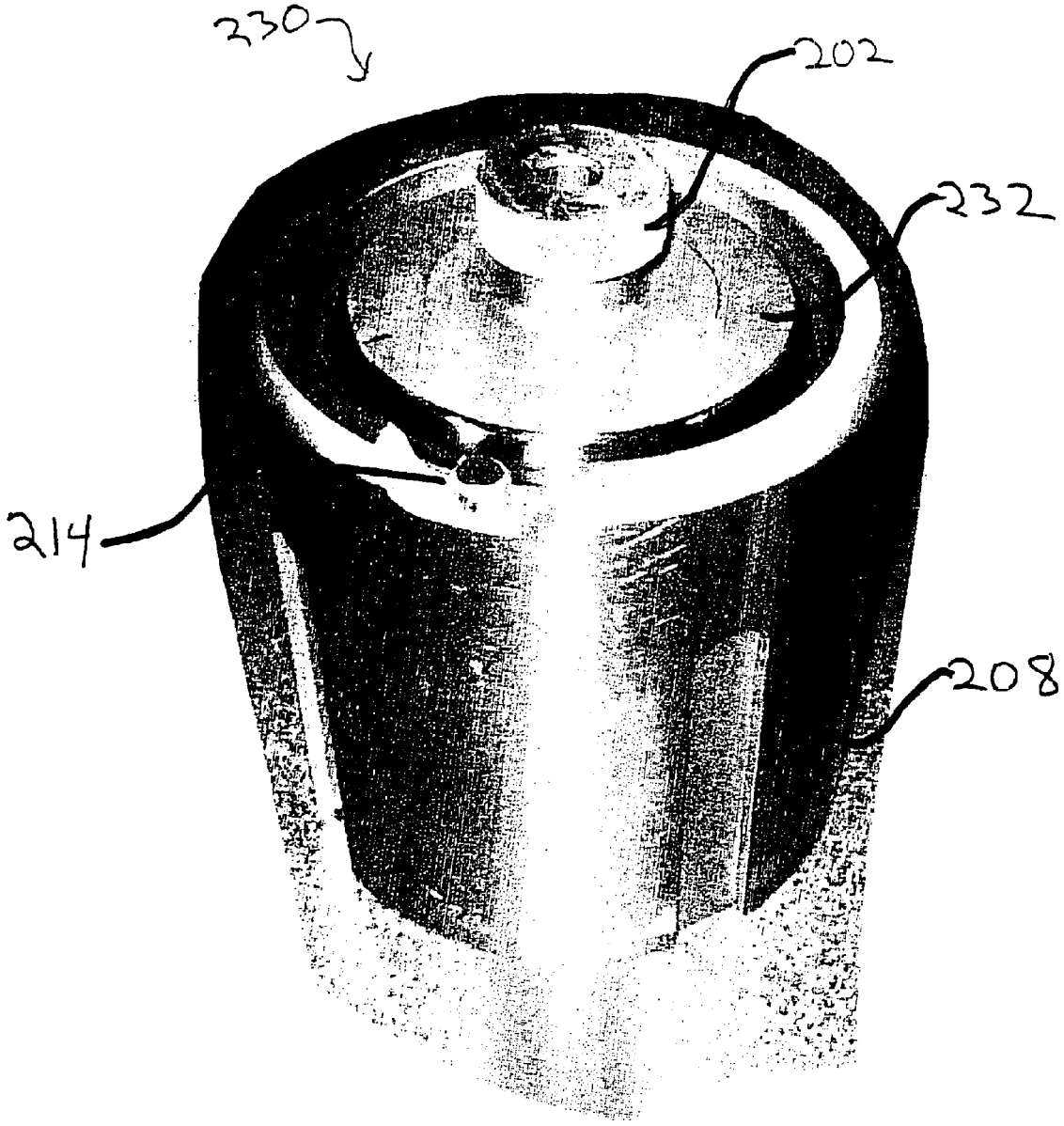
FIG. 5 is a perspective view of another punch tool according to the present invention, including a locking disk with radially, outwardly open locking cavities.

Referring now to FIG. 5, another embodiment punch tool is illustrated in punch tool 230. Punch tool 230 includes a punch driver 202 and a locking disk or collar 232, which is in turn disposed within a punch guide 208. A latch mechanism 214 is also shown in FIG. 5. Latch 214 can be used to prevent free and unwanted rotation of punch driver 202 within the punch housing (not shown in FIG. 5), which is commonly fixed with respect to rotation relative to punch guide 208. Latch 214 operates by releasably preventing rotation of disk 232 relative to latch 214, where latch 214 is secured to punch guide 208, and where locking disk or collar 232 is secured to punch driver 202. Punch guide 209 has an upper rim 209, with latch 214 being recessed vertically below rim 209.

Figure 6:
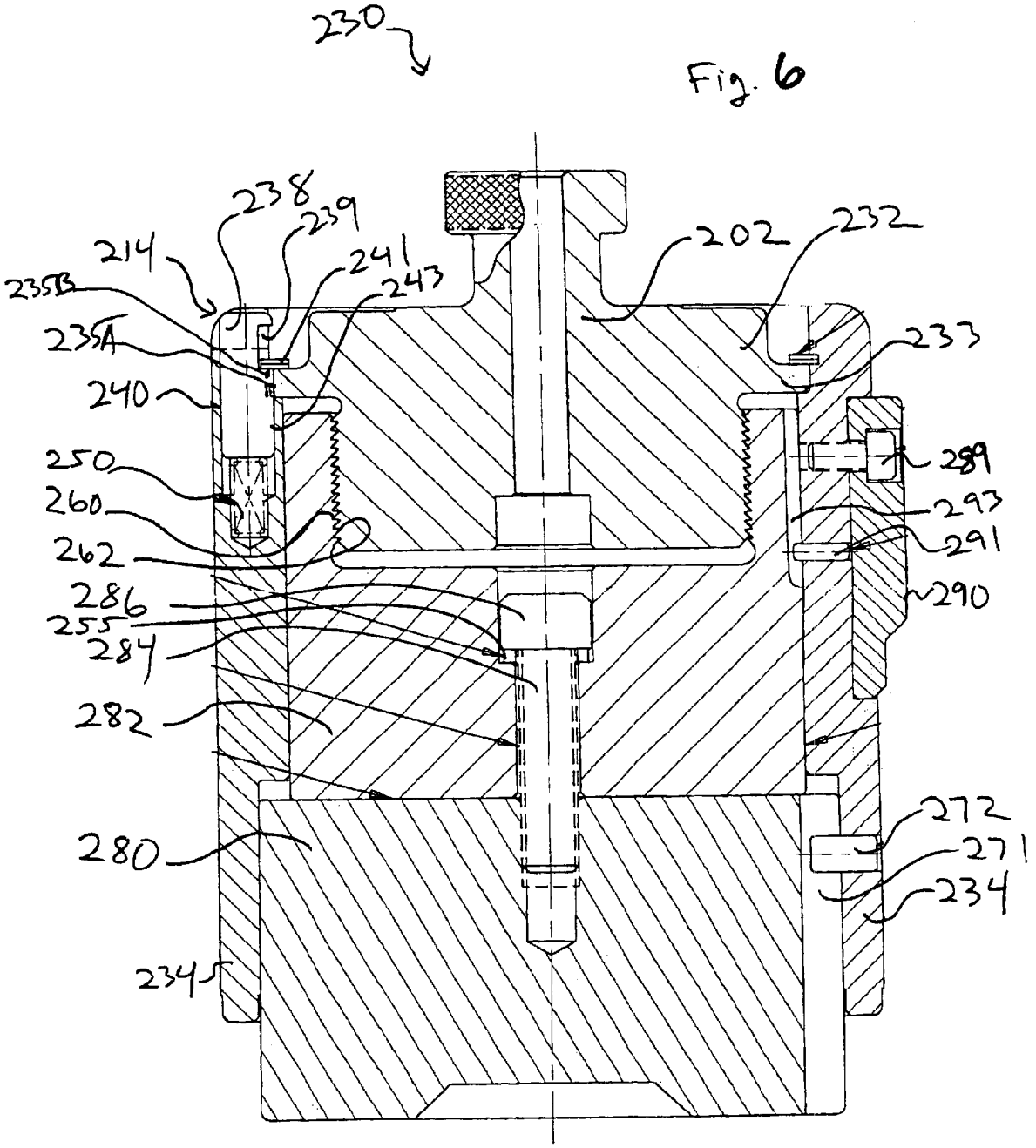
FIG. 6 is a side, cross-sectional view of the punch tool of FIG. 5.

Referring now to FIG. 6, punch tool 230 is shown in cross-section. Punch tool 230 includes generally a punch driver 202, a locking disk or collar 232, and a punch guide 234. Punch tool 230 also includes generally a punch, which may be considered to consist of a punch mounting bolt 284 disposed within a bore within a punch holder 282, which is secured to a punch lower portion 280, again by punch mounting bolt 284. Punch mounting bolt 284 may be directly received against a punch holder shoulder or washer 255. Punch mounting bolt 284 may be rotated from mounting bolt head 286. Mounting bolt 284 may be threadably received within punch lower portion 280, thereby applying tension to punch lower portion 280. Punch lower portion 280 can be slidably received within punch guide 234, free to move downward toward a work piece. In one embodiment, punch lower portion 280 also includes a keyway or outer axial groove 271 which can receive an inwardly protruding key, dowel, or pin 272. Dowel 272 can prevent rotation of punch lower portion 280.

In one embodiment, punch driver 202 and locking disk 232 can be formed as separate members. In one embodiment, as illustrated in FIG. 5, punch driver 202 and locking disk 232 are formed as an integral unit.

As previously discussed, the punch element may be considered to be a combination of the punch guide 234, the punch holder 282, and the punch which can include punch lower portion 280 and punch mounting bolt 284. Punch holder 282 includes internal threads 260, and punch driver 202 includes external threads 262, for engaging punch holder inner threads 260. As previously discussed, the punch and punch housing are generally fixed with respect to rotation relative to punch guide 234. However, punch driver 202 can be rotated about its axis along threads 260 and 262. As free rotation of punch driver 202 relative to the punch element or punch housing 282 is generally undesired, the rotation should be allowed only when desired. As can be seen from inspection of FIG. 6, the effective length of punch tool 230 can be adjusted by rotating punch driver 202 within punch element or punch housing 282.

Latch 214 may be seen to include generally a latch housing 240 having a latch spring cavity 250 within for housing a biasing spring to force upward a latch member or finger 238. As illustrated in FIG. 6, latch member 238 has been forced upward, limited in upward travel by a clip 241. Latch member 238 may be seen to have a recess or indented area 239. Latch 214 may be seen to have a larger outer diameter region 243. Larger outer diameter region 243 has a larger outer diameter or cross-sectional area than indent 239.

Locking disk 232 has regions of greater and lesser outer diameter disposed about its periphery. A locking disk greater outer diameter region 235B is shown in phantom in FIG. 6, behind latch member 238. A reduced outer diameter region 235A to locking disk 232 is also shown, being clear of latch member 238. Locking disk 232 is thus prevented from rotation past latch member 238 as this would bring locking disk greater outer diameter portion 235B into contact with latch member 238. If latch member 238 were to be depressed, this would bring a rotated locking disk increased outer diameter region 235B through recess or indent 239, thereby allowing locking disk 232 and punch driver 202 to be rotated relative to the punch element or punch holder 282.

Thus, when the effective length of punch tool 230 is to be adjusted, latch member 238 can be depressed against the latch biasing spring within latch biasing spring cavity 250, thereby allowing the increased outer diameter regions of locking disk 232 to pass through indent 239, thereby allowing punch driver 202 to be rotated and the tool length along threads 260 and 262 to be adjusted.

Punch tool 230 also includes a key 290 secured to punch guide 234 with a key mounting bolt 289. Key 290 can press a pin or dowel 291 into a key or groove 293 formed along the side of punch housing 282. Dowel 291 and groove 293 can together thus prevent rotation of punch holder 282 about its central axis. Punch holder 282 is thus also secured with respect to rotation to punch guide 234.

Figure 7A:
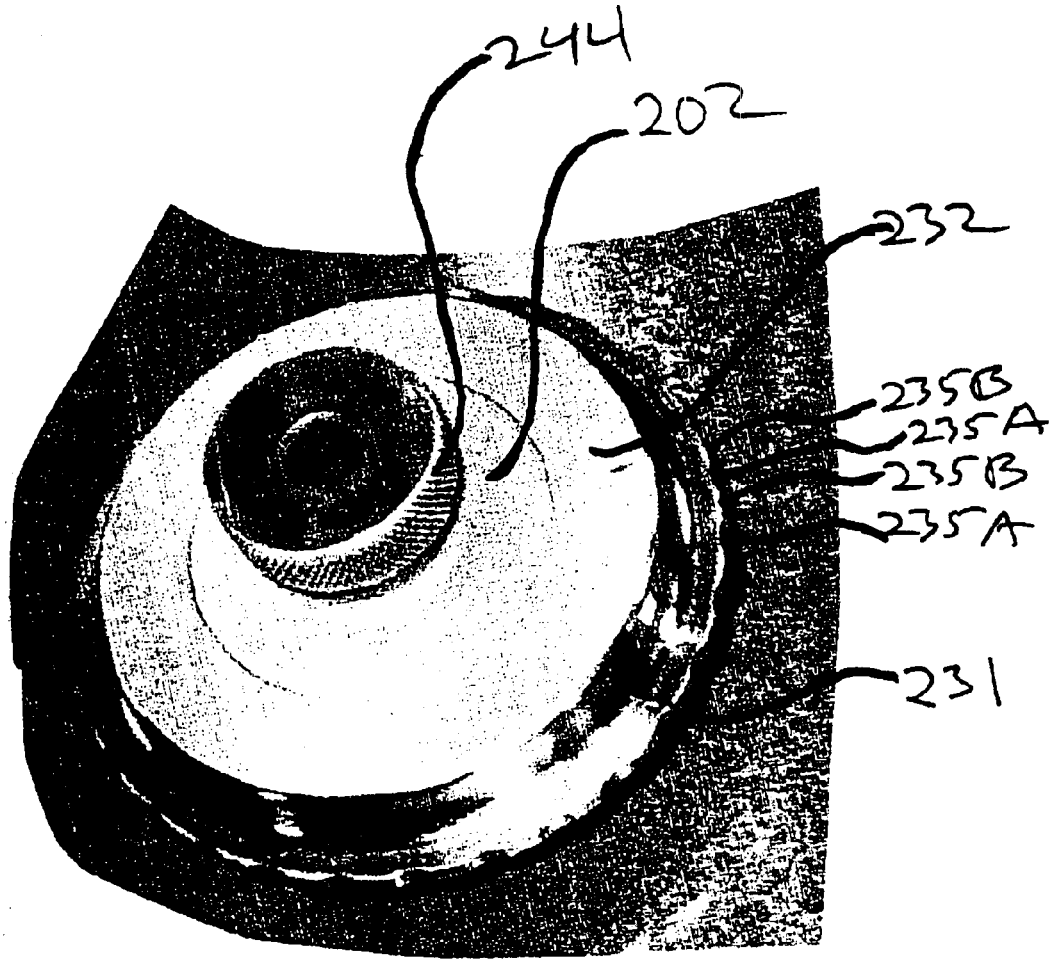
FIG. 7A is a top, perspective view of the punch driver and locking disk of FIG. 5, the disk having circumferentially spaced grooves or slots disposed about the outer periphery.

Referring now to FIG. 7A, punch driver 202, having a punch driver head 244, is shown disposed within locking disk or collar 232. Locking disk or collar 232 includes a lower portion 231 having inwardly extending slots between regions of greater outer diameter. The inwardly extending slots or regions of reduced outer diameter 235A are disposed between regions of greater outer diameter 235B. When a latching member is disposed within an inwardly extending slot 235A, in a position such that the latching member fall outer diameter is disposed within inwardly extending slot 235A, then free rotation of locking disk 232 is inhibited. When a latching member is disposed such that an indented or region of latch reduced outer diameter is disposed toward locking disk lower region 231, then larger outer diameter disk regions 235B are able to pass through the recess or indent, thereby allowing rotation of locking disk 232. Locking disk 232, in the embodiment illustrated, also includes a lower, externally threaded member (not shown in FIG. 7A) for engaging punch holder 282 (also not shown in FIG. 7A).

Figure 7B:
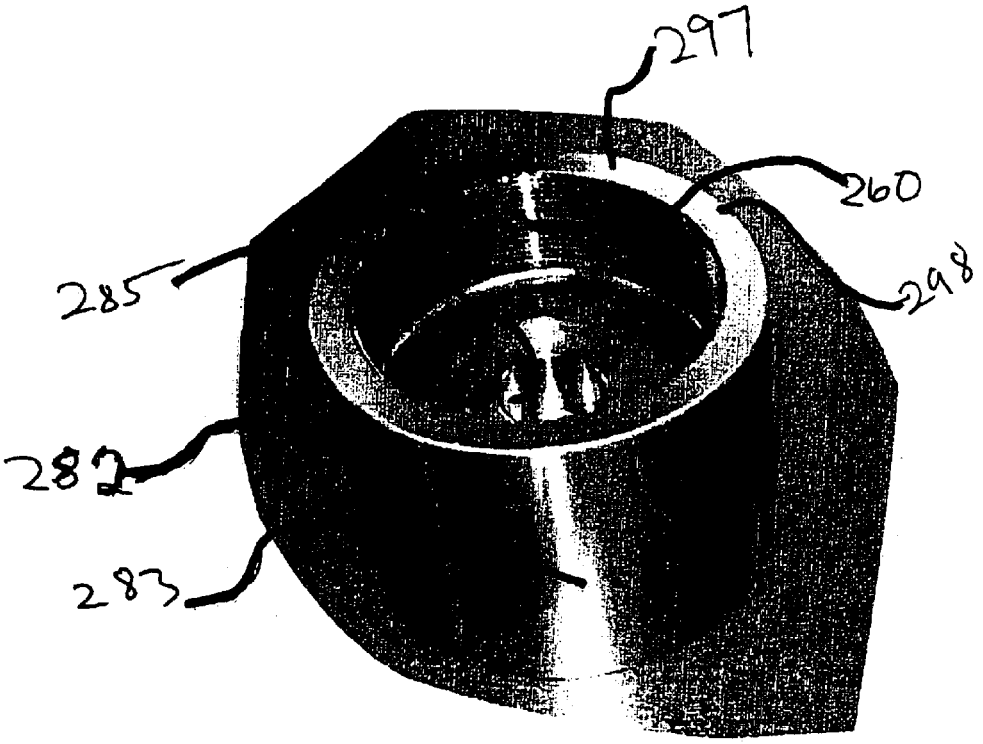
FIG. 7B is a top, perspective view of the punch holder in the punch tool of FIG. 5.

Referring now to FIG. 7B, punch holder 282 is shown, including internal threaded region 260 for engaging a threaded region of the punch driver and/or locking disk, depending on the embodiment. In one embodiment, locking disk 232 lies atop a punch holder upper shoulder rim. Punch holder 282 also includes a central bore 285 for receiving a punch mounting bolt, such as punch mounting bolt 284 of FIG. 6. Punch holder 282 also includes an outer surface 283, which can be received slidably within a punch guide, such as punch guide 234 of FIG. 6. A punch lower portion can thus be secured to the bottom of punch holder 282. Punch holder 282 can also include a groove, or indent 298 which can be received to receive a dowel or key, for example dowel 291 of FIG. 6. Indent 298 can be used to prevent unwanted rotation of punch holder 282 within a punch guide.

Figure 7C:
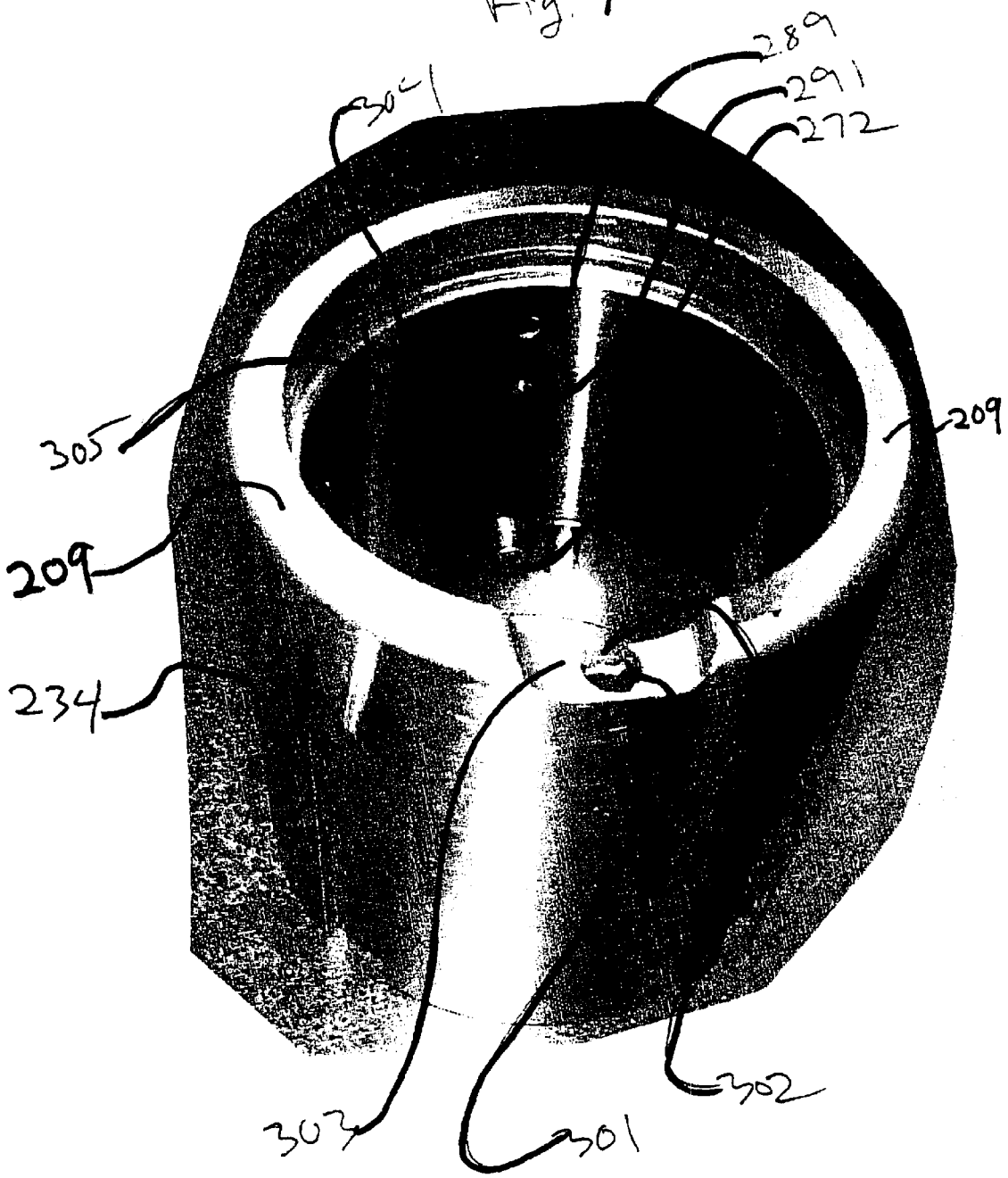
FIG. 7C is a top, perspective view of the punch guide in the punch tool of FIG. 5.

FIG. 7C illustrates punch guide 234 of FIG. 6. Punch guide 234 includes an upper wall indent 303 into upper rim 209 for including generally the latch mechanism. A lumen 301 is included to slidably receive the spring biased latch member 238 previously discussed. Lumen 301 includes an inwardly opened side faced 302 which can be used to allow indent 239 of latch member 238 to face inward and to block or allow passage of the scalloped or indented locking disk as previously described. Punch guide 234 includes generally an inner surface 305 which can receive punch holder 282 and punch lower portion 280. Dowel 272 may be seen within punch holder 234, used to prevent rotation of punch lower portion 280, as previously described. Dowel 291 may also be seen within punch holder 234, and can be used to inhibit rotation of punch holder 282, as previously described. A bore for receiving mounting bolt 289 may be seen within, also as previously described. Pins 272 and 291 can thus be used to ensure that the punch lower portion and the punch holder do not rotate apart from punch guide 234, while allowing axial movement of punch holder and the punch lower portion within punch guide 234.

Figure 8:
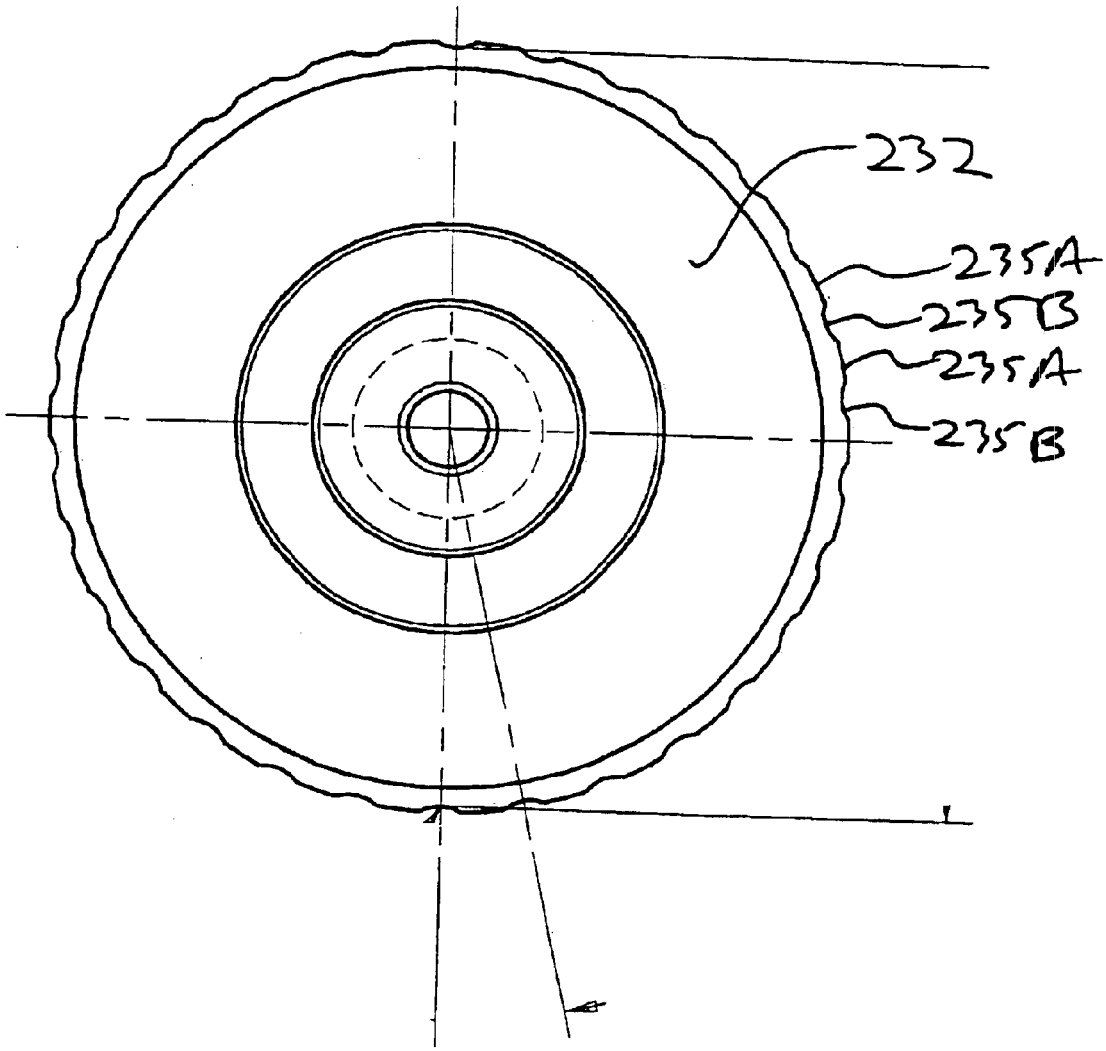
FIG. 8 is a top view of the locking disk or collar of the punch tool of FIGS. 5 and 6.

Referring now to FIG. 8, locking disk or collar 232 is illustrated. Locking disk 232 includes inward slots or indents 235B. As previously discussed, inward slots 235B form regions of lesser outer diameter relative to greater outer diameter regions 235A disposed therebetween. As previously discussed, in most embodiments, greater outer diameter regions 235A are free to rotate past a latching member such as latching member 238, only when the latching member is presenting a reduced outer diameter region to the disk, which allows the locking disk larger outer diameter region 235A to pass through the indent or recess.

Figure 9:
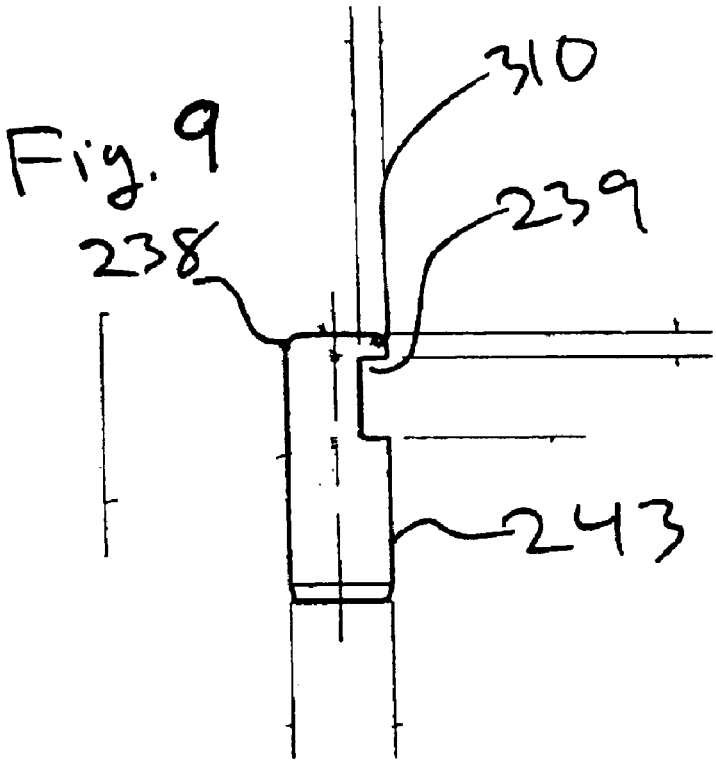
FIG. 9 is a side view of a latching member of the punch tool of FIG. 5.

Referring now to FIG. 9, latching member 238 is further illustrated. Latching member 238 may be seen to have indent 239, a region of reduced outer diameter. Latching member 238 also includes region 243, having a greater outer diameter than indent 239. Latching member 238 may also be seen to have an upper lip 310, also having a greater outer diameter than indent 239. Upper lip 310 can prevent latching member 238 from inadvertently being depressed below a locking collar or disk.

What is claimed is:

1. A punch tool comprising a punch element comprising a punch having a lower punch tip, and a punch driver element having an upper surface adapted to be engaged by the ram of a punch press in a punching operation, said elements being axially aligned and threaded together to enable axial adjustment of the length of the combined punch driver and punch element in response to relative rotation of said elements, one of said elements including, adjacent its periphery and spaced from its axis, a latch movable along an axis parallel to the axis of said elements between an upper, locked position preventing relative rotation of said elements and a lower, unlocked position permitting relative rotation of said elements, and a spring having a predetermined spring constant and urging said latch into its upper, locked position, said latch having a sufficiently low mass and said spring having a sufficiently great spring constant as to prevent said latch from unintentional movement into its unlocked position in response to striking of the punch driver element by a punch press ram during a punching operation, said puch element including a punch guide having a bore through which said punch axially moves in a punching operation, and wherein said punch guide includes an upper peripheral portion having a housing receiving said latch and spring and an upper rim, said punch driver element including a locking disc positioned beneath said upper rim of said punch guide, said disc having a plurality of circumferentially spaced grooves in its outer periphery receptive of said latch when the latter is in its upper, locked position to prevent rotation of said punch driver element with respect to said punch guide.

2. The punch tool of claim 1 wherein said latch comprises a body configured to be axially received in said grooves, said body having a recess along its length that is receptive of said disc when said latch is moved to its lower, unlocked position to enable said disc to rotate with respect to said latch.

3. The punch tool of claim 2 wherein said latch includes a manually accessible surface extending upwardly no higher than said rim to facilitate manual downward movement of said latch.

* * * * *